US011155081B2

(12) United States Patent
Ito

(10) Patent No.: US 11,155,081 B2
(45) Date of Patent: Oct. 26, 2021

(54) LIQUID DISCHARGE HEAD AND PRINTER

(71) Applicant: TOSHIBA TEC KABUSHIKI KAISHA, Tokyo (JP)

(72) Inventor: Shota Ito, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/776,962

(22) Filed: Jan. 30, 2020

(65) Prior Publication Data

US 2020/0276808 A1 Sep. 3, 2020

(30) Foreign Application Priority Data

Mar. 1, 2019 (JP) ..... JP2019-037759

(51) Int. Cl.
*B41J 2/045* (2006.01)

(52) U.S. Cl.
CPC ..... *B41J 2/04588* (2013.01); *B41J 2/04541* (2013.01); *B41J 2/04581* (2013.01)

(58) Field of Classification Search
CPC ..... B41J 2/04588; B41J 2/04541; B41J 2/04581; B41J 2/04595; B41J 2/04516; B41J 2002/14491; B41J 2002/14362; B41J 2/14209; B41J 2/14; B41J 2/015
USPC ..... 347/10
See application file for complete search history.

(56) References Cited

U.S. PATENT DOCUMENTS

2008/0252672 A1* 10/2008 Komai ..... B41J 2/04581 347/11
2009/0315930 A1 12/2009 De Meutter
2017/0008280 A1* 1/2017 Nitta ..... B41J 2/04581
2017/0165964 A1 6/2017 Misawa et al.
2017/0259564 A1 9/2017 Nitta et al.

FOREIGN PATENT DOCUMENTS

JP 2016-034720 A 3/2016
JP 2017-128019 A 7/2017
JP 2018-114642 A 7/2018

OTHER PUBLICATIONS

Extended European Search Report dated Jul. 9, 2020 mailed in corresponding European Patent Application No. 20158263.2, 97 pages.

* cited by examiner

*Primary Examiner* — Huan H Tran
*Assistant Examiner* — Alexander D Shenderov
(74) *Attorney, Agent, or Firm* — Kim & Stewart LLP

(57) ABSTRACT

A liquid discharge head includes an actuator and a drive circuit. The actuator is configured to expand and contract a pressure chambers. The drive circuit is configured to apply a first drive waveform to cause the actuator to discharge a liquid droplet at a first speed, and then a second drive waveform after the first drive waveform to cause the actuator to discharge a liquid droplet at a second speed slower than the first speed.

19 Claims, 8 Drawing Sheets

FIG. 11

| | Frame | 01 | 02 | 03 | 04 | 05 | 06 | 07 |
|---|---|---|---|---|---|---|---|---|
| | Time Set | 1 | 1 | 1 | 1 | 1 | 1 | 1 |
| Drop | 0h | NEG | NEG | NEG | NEG | NEG | NEG | NEG |
| | 1h | ACT | DMP | NEG | NEG | NEG | NEG | NEG |
| | 2h | ACT | ACT | DMP | NEG | NEG | NEG | NEG |
| | 3h | ACT | ACT | ACT | DMP | NEG | NEG | NEG |
| | 4h | ACT | ACT | ACT | ACT | DMP | NEG | NEG |
| | 5h | ACT | ACT | ACT | ACT | ACT | DMP | NEG |
| | 6h | ACT | ACT | ACT | ACT | ACT | ACT | DMP |
| | 7h | ACT | ACT | ACT | ACT | ACT | ACT | ACT |

LIQUID DISCHARGE HEAD AND PRINTER

CROSS-REFERENCE TO RELATED APPLICATION

This application is based upon and claims the benefit of priority from Japanese Patent Application No. 2019-037759, filed on Mar. 1, 2019, the entire contents of which are incorporated herein by reference.

FIELD

Embodiments described herein relate generally to a liquid discharge head and a printer.

BACKGROUND

Some inkjet heads that are multi-drop liquid discharge heads discharge a plurality of ink droplets to form one dot on a medium, such as sheet of paper. In such inkjet heads, a tail may be formed on an ink droplet when the ink droplet is discharged. When a tail is formed, the ink droplet may be scattered during flight and thus mist (or satellite droplets) may be generated. Therefore, print quality may be deteriorated by the mist.

DESCRIPTION OF THE DRAWINGS

FIG. 11 illustrates an example of an inkjet time set according to the embodiment.

DETAILED DESCRIPTION

Embodiments provide a liquid discharge head capable of suppressing mist and a printer.

In general, according to an embodiment, a liquid discharge head includes an actuator and a drive circuit. The actuator is configured to expand and contract a pressure chambers. The drive circuit is configured to apply a first drive waveform to cause the actuator to discharge a liquid droplet at a first speed, and then a second drive waveform after the first drive waveform to cause the actuator to discharge a liquid droplet at a second speed slower than the first speed.

Hereinafter, a printer according to an example embodiment will be described with reference to the accompanying drawings.

The printer according to the embodiment forms an image on a medium, such as a sheet of paper, using an inkjet head. The printer discharges ink present in a pressure chamber of the inkjet head onto the medium to form an image on the medium. The printer is, for example, a printer used in an office, a barcode printer, a printer for point-of-sale (POS) terminal, an industrial printer, a 3D printer, or the like. The medium on which the printer forms an image is not limited to having any specific configuration. The inkjet head included in the printer according to the embodiment is an example of a liquid discharge head, and the ink is an example of liquid.

Figure 1:
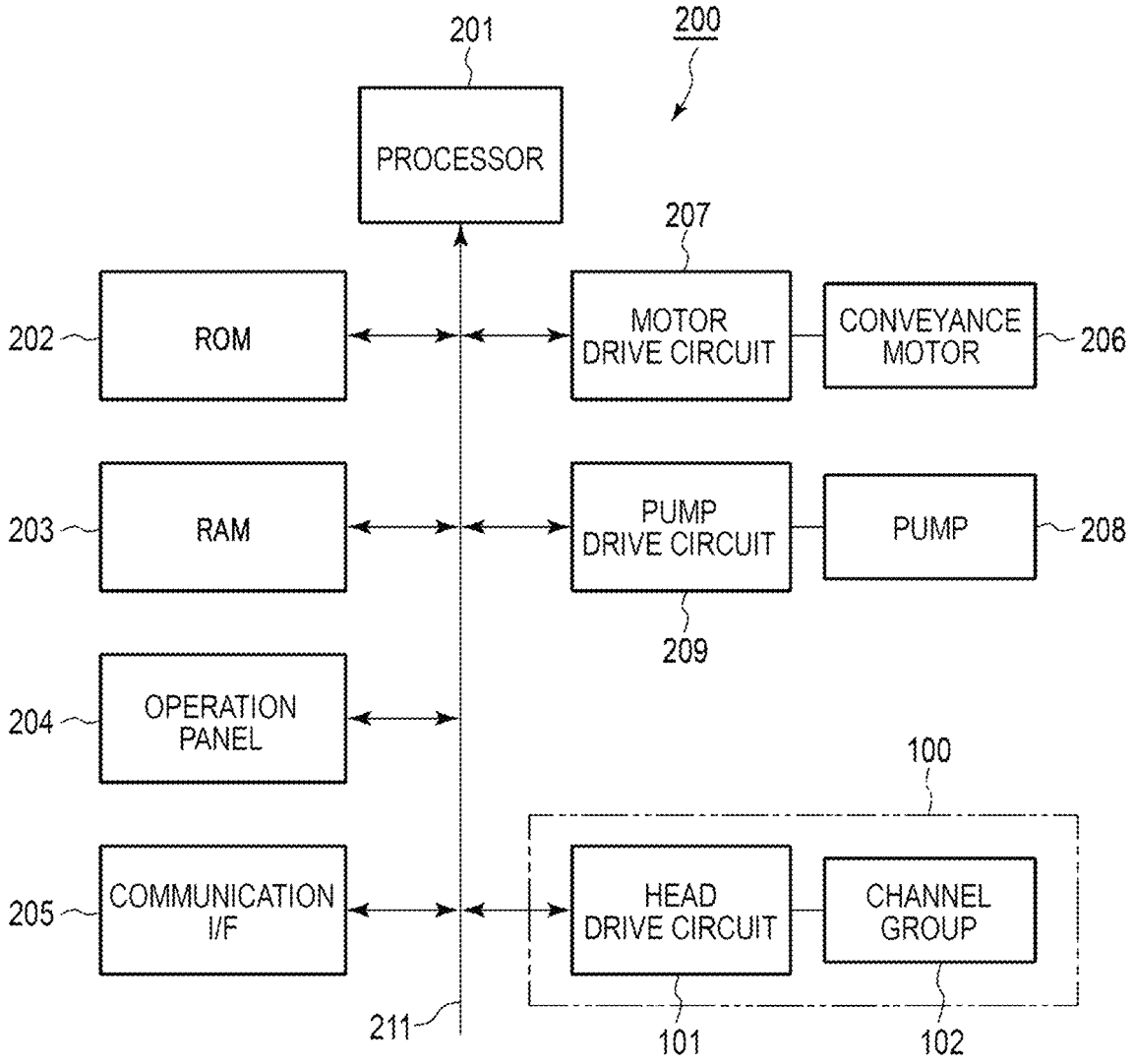
FIG. 1 is a block diagram illustrating a configuration example of a printer according to an embodiment.

FIG. 1 is a block diagram illustrating a configuration example of a printer 200.

As shown in FIG. 1, the printer 200 includes a processor 201, a ROM 202, a RAM 203, an operation panel 204, a communication interface 205, a conveyance motor 206, a motor drive circuit 207, a pump 208, a pump drive circuit 209, and an inkjet head 100. The inkjet head 100 includes a head drive circuit 101, a channel group 102, and the like. In addition, the printer 200 includes a bus line 211 such as an address bus and a data bus. The processor 201 is connected to the ROM 202, the RAM 203, the operation panel 204, the communication interface 205, the motor drive circuit 207, the pump drive circuit 209, and the head drive circuit 101 via the bus line 211 directly or via an input/output circuit. The motor drive circuit 207 is connected to the conveyance motor 206. The pump drive circuit 209 is connected to the pump 208.

The printer 200 may further include a component as necessary in addition to the components shown in FIG. 1, or may exclude a specific component from the printer 200.

The processor 201 has a function of controlling the operation of the entire printer 200. The processor 201 may include an internal cache or various interfaces. The processor 201 performs various processing by executing programs stored in advance in the internal cache and the ROM 202. The processor 201 performs various functions as the printer 200 by executing an operating system, application programs, and the like.

Some of the various functions performed by the processor 201 executing the programs may be performed by a hardware circuit. In this case, the processor 201 controls functions to be performed by the hardware circuit.

The ROM 202 is non-volatile memory in which a control program, control data, and the like are stored in advance. The control program and the control data stored in the ROM 202 are incorporated in advance according to a specification of the printer 200. For example, the ROM 202 stores the operating system, application programs, and the like.

The RAM 203 is volatile memory. The RAM 203 temporarily stores data being processed by the processor 201 and the like. The RAM 203 stores various application programs based on commands from the processor 201. The RAM 203 may store data necessary for executing an application program, an execution result of the application program, and the like. The RAM 203 may function as an image memory in which print data is decompressed.

The operation panel 204 is an interface used for receiving an input of an instruction from an operator and displaying various kinds of information to the operator. The operation panel 204 includes an operation section for receiving an input of an instruction and a display section for displaying information.

The operation panel 204 transmits a signal indicating an operation received from the operator to the processor 201 as an operation of the operation section. For example, in the operation section, function keys such as a power key, a sheet feed key, an error release key and the like are arranged.

The operation panel 204 displays various kinds of information based on the control of the processor 201 as the operation of the display section. For example, the operation panel 204 displays a state of the printer 200 and the like. For example, the display section may be a liquid crystal monitor.

The operation section may be a touch panel. In this case, the display section may be formed integrally with the touch panel as the operation section.

The communication interface 205 is an interface used for transmitting and receiving data to and from an external device via a network such as a local area network (LAN). For example, the communication interface 205 supports a LAN connection. For example, the communication interface 205 receives print data from a client terminal via the network. For example, when an error occurs in the printer 200, the communication interface 205 transmits a signal for notifying the error to the client terminal.

The motor drive circuit 207 controls driving of the conveyance motor 206 in response to a signal from the processor 201. For example, the motor drive circuit 207 transmits electric power or a control signal to the conveyance motor 206.

Based on the control of the motor drive circuit 207, the conveyance motor 206 functions as a driving source of a print media conveyor or other conveyance mechanism for conveying a medium such as a sheet to be printed. When the conveyance motor 206 is driven, the conveyance mechanism (e.g., a print media conveyor) starts conveying the medium. The conveyance mechanism conveys the medium to a printing position for the inkjet head 100. The conveyance mechanism discharges the medium after the printing to the outside of the printer 200 from a discharge port. The motor drive circuit 207 and the conveyance motor 206 constitute a conveyance section for conveying the medium.

The pump drive circuit 209 controls driving of the pump 208. When the pump 208 is driven, the ink is supplied from an ink tank to the inkjet head 100.

The inkjet head 100 discharges ink droplets onto the medium based on the print data. The inkjet head 100 includes the head drive circuit 101, the channel group 102, and the like.

Hereinafter, the inkjet head according to an embodiment will be described with reference to the accompanying drawings. In the embodiment, a share mode type inkjet head 100 (refer to FIG. 2) is exemplified. The inkjet head 100 discharges the ink onto a sheet. The medium onto which the inkjet head 100 discharges the ink is not limited to having a specific configuration.

Figure 2:
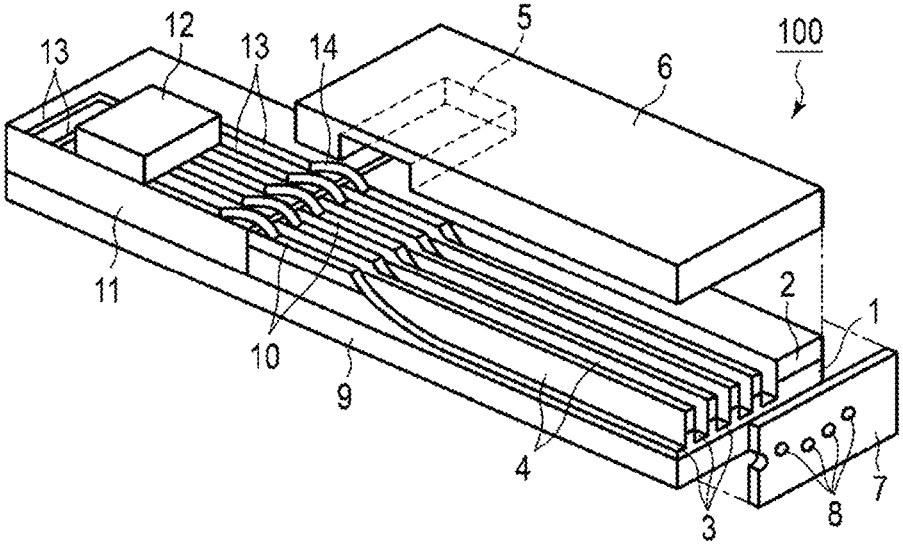
FIG. 2 illustrates an example of a perspective view of an inkjet head according to the embodiment.
Figure 3:
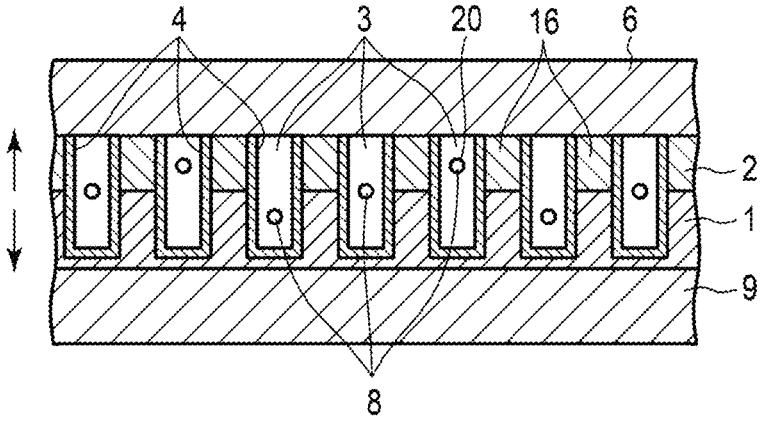
FIG. 3 illustrates an example of a cross-sectional view of the inkjet head according to the embodiment.
Figure 4:
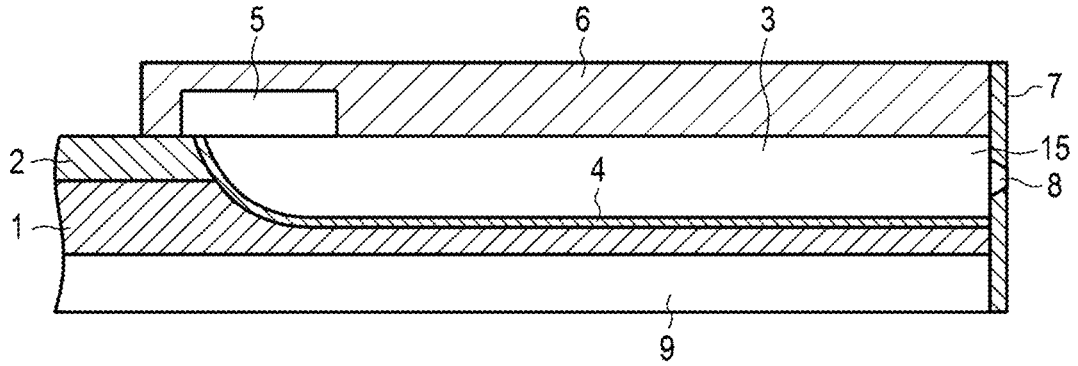
FIG. 4 illustrates an example of a longitudinal cross-sectional view of the inkjet head according to the embodiment.

Next, the configuration example of the inkjet head 100 will be described with reference to FIGS. 2 to 4. FIG. 2 illustrates a perspective view of a part of the inkjet head 100 in an exploded manner. FIG. 3 illustrates a transverse cross-sectional view of the inkjet head 100. FIG. 4 illustrates a longitudinal cross-sectional view of the inkjet head 100.

The inkjet head 100 has a base plate 9. In the inkjet head 100, a first piezoelectric member 1 is bonded to an upper surface of the base plate 9, and a second piezoelectric member 2 is bonded to an upper surface of the first piezoelectric member 1. The first piezoelectric member 1 and the second piezoelectric member 2 bonded to each other are polarized in mutually opposite directions in a plate thickness direction, as indicated by arrows in FIG. 3.

The base plate 9 is formed using a material having a small dielectric constant and a small difference in thermal expansion coefficient with the first piezoelectric member 1 and the second piezoelectric member 2. As the material of the base plate 9, for example, alumina ($Al_2O_3$), silicon nitride ($Si_3N_4$), silicon carbide (SiC), aluminum nitride (AlN), lead titanate zirconate (PZT) or the like may be used. As the material of the first piezoelectric member 1 and the second piezoelectric member 2, lead zirconate titanate (PZT), lithium niobate ($LiNbO_3$), lithium tantalate ($LiTaO_3$) or the like may be used.

In the inkjet head 100, a large number of elongated grooves 3 are provided from a front end side to a rear end side of each of the first piezoelectric member 1 and the second piezoelectric member 2, which are bonded to each other. Each groove 3 is arranged in parallel at a certain interval therebetween. Each groove 3 is arranged with a front end thereof open and a rear end thereof inclined (angled) upwards.

In the inkjet head 100, electrodes 4 are provided on side walls and a bottom surface of each groove 3. The electrode 4 has a two-layer structure formed of nickel (Ni) and gold (Au). The electrode 4 is uniformly formed in each groove 3 by, for example, a plating method. A method of forming the electrode 4 is not limited to the plating method. For example, a sputtering method, an evaporation method, or the like can also be used.

The inkjet head 100 includes an extraction electrode 10 from the rear end of each groove 3 towards the upper surface of a rear portion of the second piezoelectric member 2. The extraction electrode 10 extends from the electrode 4.

The inkjet head 100 includes a top plate 6 and an orifice plate 7. The top plate 6 seals an upper portion of each groove 3. The orifice plate 7 seals the front end of each groove 3. In the inkjet head 100, a plurality of pressure chambers 15 are formed by the respective grooves 3 surrounded by the top plate 6 and the orifice plate 7. The pressure chamber 15 is filled with the ink supplied from the ink tank. The pressure chamber 15 has a shape in which a depth thereof is 300 μm and a width thereof is 80 μm, for example, and a plurality of pressure chambers 15 are arranged in parallel at a pitch of 169 μm. Such a pressure chamber 15 is also called an ink chamber.

The top plate 6 includes a common ink chamber 5 at a rear portion of the inside thereof. The orifice plate 7 includes nozzles 8 at positions facing respective grooves 3. The nozzle 8 communicates with the facing groove 3, that is, the pressure chamber 15. The nozzle 8 has a tapered shape from the pressure chamber 15 side towards an ink discharge side on the opposite side. The nozzles 8 corresponding to three adjacent pressure chambers 15 are assumed as one set, and a plurality of nozzles 8 is formed by being shifted at a certain interval in a height direction of the groove 3 (vertical page direction in FIG. 3).

When the pressure chamber 15 is filled with ink, a meniscus 20 of ink is formed in the nozzle 8. The meniscus 20 is formed along an inner wall of the nozzle 8.

The first piezoelectric member 1 and the second piezoelectric member 2 constituting a partition wall of the pressure chambers 15 are sandwiched by the electrodes 4 provided in each of the pressure chambers 15 to form an array of actuators 16 for driving the pressure chambers 15.

In the inkjet head 100, a printed board 11 on which a conductive pattern 13 is formed is bonded to an upper surface on the rear side of the base plate 9. In the inkjet head 100, a drive IC (Integrated Circuit) 12, on which the head drive circuit 101 is mounted, is on the printed board 11. The drive IC 12 is connected to the conductive pattern 13. The conductive pattern 13 is bonded to each extraction electrode 10 via a conductor wire 14 by wire bonding.

A group constituted of the pressure chamber 15, the electrode 4 and the nozzle 8 of the inkjet head 100 is referred to as a channel. That is, the inkjet head 100 has channels ch. 1, ch. 2, . . . ch. N, of which the number is equal to the number N of the grooves 3.

Figure 5:
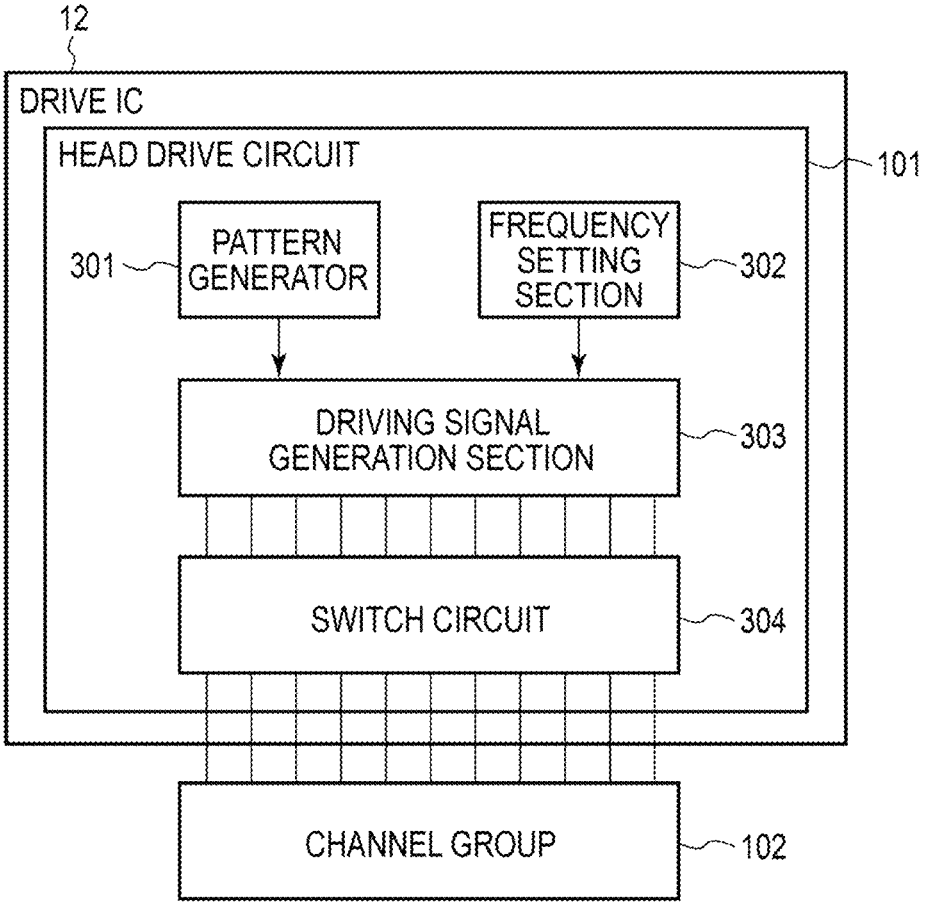
FIG. 5 is a block diagram illustrating a configuration example of a head drive circuit according to the embodiment.

Next, the head drive circuit 101 will be described. FIG. 5 is a block diagram illustrating a configuration example of the head drive circuit 101. As described above, the head drive circuit 101 is included in the drive IC 12.

The head drive circuit 101 drives the channel group 102 of the inkjet head 100 based on the print data.

The channel group 102 includes a plurality of channels (ch 1, ch. 2, . . . ch. N) including the pressure chamber 15, the electrode 4 and the nozzle 8. That is, based on a control signal from the head drive circuit 101, the channel group 102 discharges the ink droplet by an operation of each pressure chamber 15 expanded and contracted by the actuator 16.

As shown in FIG. 5, the head drive circuit 101 includes a pattern generator 301, a frequency setting section 302, a driving signal generation section 303, and a switch circuit 304.

The pattern generator 301 generates various waveform patterns using a waveform pattern of an expansion pulse for expanding a volume of the pressure chamber 15, a release period in which the volume of the pressure chamber 15 is released, and a waveform pattern of a contraction pulse for contracting the volume of the pressure chamber 15.

The pattern generator 301 generates a waveform pattern of an ACT drive waveform (first drive waveform) and a DMP drive waveform (second drive waveform). The period of each of the ACT drive waveform and the DMP drive waveform is a section for discharging one ink droplet, that is, a so-called one drop cycle.

The ACT drive waveform and the DMP drive waveform are described below.

The frequency setting section 302 sets a driving frequency of the inkjet head 100. The driving frequency is a frequency of a driving pulse generated by the driving signal generation section 303. The head drive circuit 101 operates in response to a driving pulse.

The driving signal generation section 303 generates a pulse for each channel according to the print data input through the bus line based on the waveform pattern generated by the pattern generator 301 and the driving frequency set by the frequency setting section 302. The pulse for each channel is output from the driving signal generation section 303 to the switch circuit 304.

The switch circuit 304 switches a voltage to be applied to the electrode 4 of each channel in response to the pulse for each channel output from the driving signal generation section 303. That is, the switch circuit 304 applies a voltage to the actuator 16 of each channel based on an energization time of the expansion pulse or the like that is set by the pattern generator 301.

By switching the voltage, the switch circuit 304 expands or contracts the volume of the pressure chamber 15 of each channel so as to discharge ink droplets according to the number of gradations intended for the nozzle 8 of each channel.

Next, an operation example of the inkjet head 100 configured as described above will be described using FIGS. 6 to 8.

Figure 6:
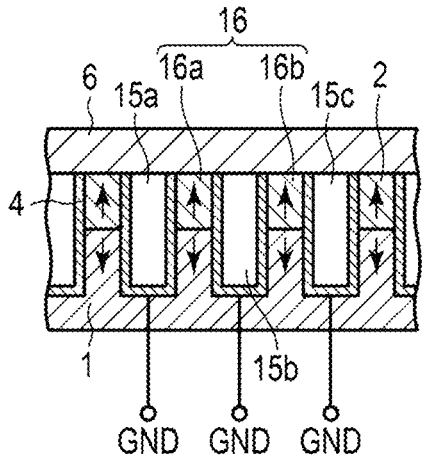
FIG. 6 is a diagram illustrating the inkjet head according to the embodiment during a release period.

FIG. 6 shows a state of a pressure chamber 15*b* in the release period. As shown in FIG. 6, in the head drive circuit 101, potentials of the electrodes 4 arranged on the respective wall surfaces of the pressure chamber 15*b* and pressure chambers 15*a* and 15*c* adjacent to the pressure chamber 15*b* are all set to a ground potential GND. In this state, the deformation does not occur in both a partition wall 16*a* sandwiched between the pressure chamber 15*a* and the pressure chamber 15*b* and a partition wall 16*b* sandwiched between the pressure chamber 15*b* and the pressure chamber 15*c*.

Figure 7:
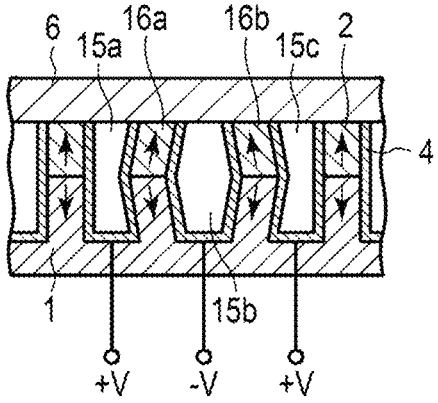
FIG. 7 is a diagram illustrating the inkjet head according to the embodiment during a period for expansion.

FIG. 7 shows an example of a state in which the head drive circuit 101 applies the expansion pulse to the actuator 16 of the pressure chamber 15*b*. As shown in FIG. 7, the head drive circuit 101 applies a negative voltage −V to the electrode 4 of the central pressure chamber 15*b* while applying a positive voltage +V to the electrodes 4 of the pressure chambers 15*a* and 15*c* adjacent to the pressure chamber 15*b*. In this state, an electric field of the voltage 2V acts on each of the partition walls 16*a* and 16*b* in a direction orthogonal to a polarization direction of the first piezoelectric member 1 and the second piezoelectric member 2. Due to this action, each of the partition walls 16*a* and 16*b* is deformed outward to expand the volume of the pressure chamber 15*b*.

Figure 8:
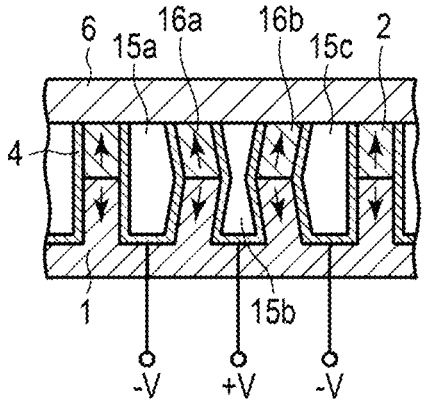
FIG. 8 is a diagram illustrating the inkjet head according to the embodiment during a period for contraction.

FIG. 8 shows an example in which the head drive circuit 101 applies the contraction pulse to the actuator 16 of the pressure chamber 15*b*. As shown in FIG. 8, the head drive circuit 101 applies a positive voltage +V to the electrode of the central pressure chamber 15*b* while applying a negative voltage −V to the electrodes 4 of both the adjacent pressure chambers 15*a* and 15*c*. In this state, an electric field of the voltage 2V acts on each of the partition walls 16*a* and 16*b* in a direction opposite to the state shown in FIG. 7. By this action, each of the partition walls 16*a* and 16*b* is deformed inward so as to contract the volume of the pressure chamber 15*b*.

When the volume of the pressure chamber 15*b* is expanded or contracted, the pressure vibration occurs in the pressure chamber 15*b*. Due to the pressure vibration, the pressure in the pressure chamber 15*b* is increased, and ink droplets are discharged from the nozzle 8 communicating with the pressure chamber 15*b*.

As described above, the partition walls 16*a* and 16*b* separating each of the pressure chambers 15*a*, 15*b* and 15*c* serve as the actuator 16 for applying the pressure vibration to the inside of the pressure chamber 15*b* with the partition walls 16*a* and 16*b* as wall surfaces thereof. In other words, the pressure chamber 15 is contracted or expanded by the operation of the actuator 16.

In addition, each pressure chamber 15 shares an actuator 16 (a partition wall) with an adjacent pressure chamber 15. For this reason, the head drive circuit 101 cannot individually drive pressure chambers 15 that are adjacent to one another. The head drive circuit 101 divides the pressure chambers 15 into groups by dividing the pressure chambers into (n+1) groups at intervals of n (where n is an integer of 2 or more) for purposes of driving the pressure chambers. In the embodiment, a case of a so-called three-division driving in which the head drive circuit 101 divides the pressure chambers 15 into groups of three at intervals of two pressure chambers is exemplified. The three-division driving is merely an example, and a four-division driving or a five-division driving may be used.

Next, an example of drive waveforms to be applied to the actuator 16 by the head drive circuit 101 will be described.

First, the ACT drive waveform to be applied to the actuator 16 by the head drive circuit 101 will be described.

The ACT drive waveform is a drive waveform for discharging ink droplets from the nozzle 8 of the pressure chamber 15 at a predetermined speed (first speed).

Figure 9:
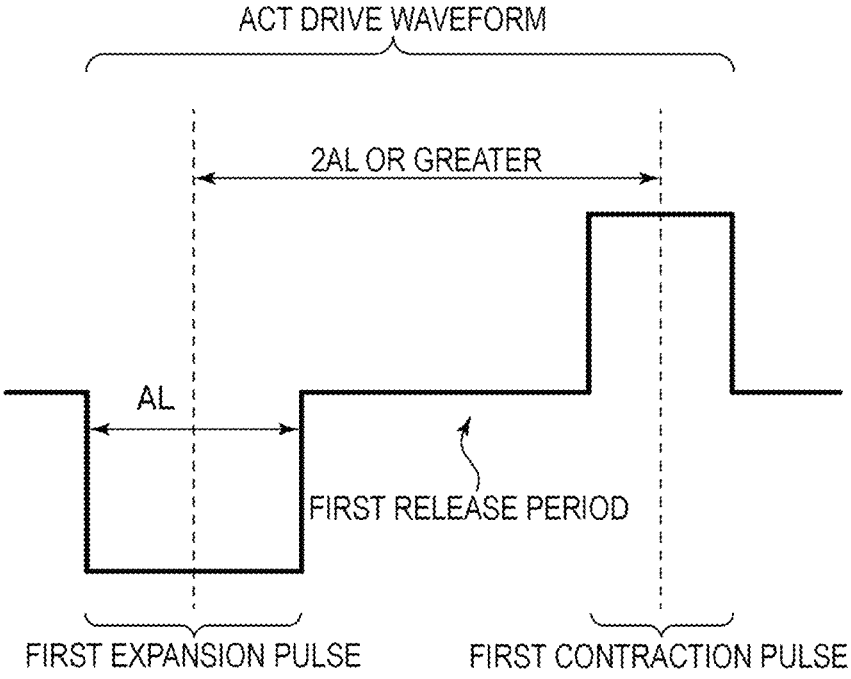
FIG. 9 is a diagram illustrating an example of an ACT drive waveform to be applied to an actuator according to the embodiment.

FIG. 9 is a diagram illustrating a configuration example of the ACT drive waveform. As shown in FIG. 9, the ACT drive waveform includes a first expansion pulse, non-pulse during a first release period, and a first contraction pulse.

First, the first expansion pulse is applied to the actuator 16. The first expansion pulse expands the volume of the pressure chamber 15 formed by the actuator 16. That is, the first expansion pulse brings the pressure chamber 15 into the state shown in FIG. 7. In this state, the pressure of the pressure chamber 15 is decreased and the ink is supplied from the common ink chamber 5 to the pressure chamber 15. The first expansion pulse is formed with a predetermined width. That is, the first expansion pulse expands the volume of the pressure chamber 15 for a predetermined time. For example, the width of the first expansion pulse is about half (AL) of the natural vibration period of the pressure in the pressure chamber 15.

After the predetermined time elapses, the pressure chamber 15 is released for the first release period. Neither an expansion pulse nor contraction pulse is applied during the first release period. That is, the pressure chamber 15 returns to the default state (the state shown in FIG. 6). The first release period has a predetermined width (i.e., duration of time). When the pressure chamber 15 returns to the default state, the pressure of the pressure chamber 15 is increased. When the pressure in the pressure chamber 15 is increased, the speed of the meniscus 20 formed in the nozzle 8 exceeds the threshold value at which ink droplets are discharged. When the speed of the meniscus 20 exceeds the discharge threshold value, ink droplets are discharged from the nozzle 8 of the pressure chamber 15.

After the first release period elapses for the pressure chamber 15, the first contraction pulse is applied to the actuator 16. The first contraction pulse reduces the volume of the pressure chamber 15 formed by the actuator 16. That is, the first contraction pulse brings the pressure chamber 15 into the state shown in FIG. 8. A pressure vibration in the pressure chamber after the ink droplet is discharged can be canceled by the first contraction pulse, so that the next discharge is not affected by the previous discharge.

Here, the width from the midpoint of the first expansion pulse to the midpoint of the first contraction pulse is greater than twice the AL.

Next, the DMP drive waveform that the head drive circuit 101 applies to the actuator 16 will be described.

The DMP drive waveform is a drive waveform for discharging ink droplets from the nozzle 8 of the pressure chamber 15 at a speed (second speed) slower than the first speed of the ACT drive waveform.

Figure 10:
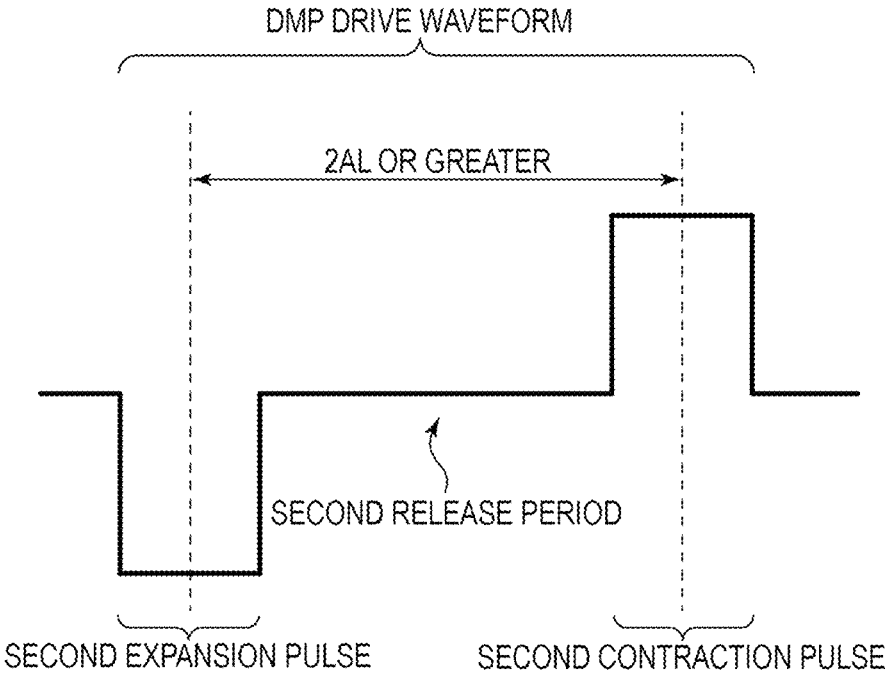
FIG. 10 is a diagram illustrating an example of a DMP drive waveform to be applied to the actuator according to the embodiment.

FIG. 10 is a diagram illustrating a configuration example of the DMP drive waveform. As shown in FIG. 10, the DMP drive waveform includes a second expansion pulse, non-pulse during a second release period, and a second contraction pulse.

First, the second expansion pulse is applied to the actuator 16. The second expansion pulse expands the volume of the pressure chamber 15 formed by the actuator 16. That is, the second expansion pulse brings the pressure chamber 15 into the state shown in FIG. 7. In this state, the pressure of the pressure chamber 15 is decreased and the ink is supplied from the common ink chamber 5 to the pressure chamber 15. The second expansion pulse has a predetermined width smaller than the width of the first extension pulse. That is, the second expansion pulse expands the volume of the pressure chamber 15 for a predetermined time shorter than the width of the first expansion pulse.

After the predetermined time elapses, the pressure chamber 15 is released for the second release period. Neither an expansion pulse nor a contraction pulse is applied during the second release period. That is, the pressure chamber 15 returns to the default state (the state shown in FIG. 6). The second release period is a predetermined period (length of time). When the pressure chamber 15 returns to the default state, the pressure of the pressure chamber 15 is increased. When the pressure of the pressure chamber 15 is increased, the speed of the meniscus 20 formed in the nozzle 8 exceeds the threshold value at which ink droplets are discharged. When the speed of the meniscus 20 exceeds the discharge threshold value, ink droplets are discharged from the nozzle 8 of the pressure chamber 15.

After the second release period elapses for the pressure chamber 15, a second contraction pulse is applied to the actuator 16. The second contraction pulse reduces the volume of the pressure chamber 15 formed by the actuator 16. That is, the second contraction pulse brings the pressure chamber 15 into the state shown in FIG. 8. A pressure vibration in the pressure chamber after ink droplets are discharged can be canceled by the second contraction pulse, so that the next discharge is not affected by the previous discharge.

In this example, the width from the midpoint of the second expansion pulse to the midpoint of the second contraction pulse is greater than twice the AL. The width from the midpoint of the second expansion pulse to the midpoint of the second contraction pulse may or may not coincide with the width from the midpoint of the first expansion pulse to the midpoint of the first contraction pulse.

The total of the width of the first expansion pulse and the first release period of the ACT drive waveform coincides with the total of the width of the second expansion pulse and the second release period of the DMP drive waveform.

Next, a "time set" that is selected when the head drive circuit 101 discharges ink droplets will be described.

The head drive circuit 101 sets/selects the time set based on print data or the like. A time set indicates the waveform to be applied to the actuator 16 over the course of several different time frames (e.g., frame 01 to 07, as depicted in FIG. 11) to form a dot. The time set specifies the number of ink droplets to be discharged, the discharge timing, and the like to form the dot.

FIG. 11 shows an example of a time set.

In the example shown in FIG. 11, the head drive circuit 101 has the time sets 0 h to 7 h as time sets which can be utilized/selected. Here, "0 h" is a time set in which no ink droplets are discharged. That is, 0 h is constituted of NEG (no discharge) values, which corresponds to no application of ACT and DMP waveforms.

The time sets 1 h to 7 h are respectively time sets in which 2 to 7 ink droplets are discharged, respectively. In FIG. 11, the "ACT" entry means that the ACT drive waveform is applied to the actuator 16. The "DMP" entry means that the DMP drive waveform is applied to the actuator 16.

As shown in FIG. 11, time sets 1 h to 6 h include one or more ACTs and a DMP after the one or more ACTs. That is, time sets 1 h to 6 h each include (number of ink droplets to be discharged−1) ACTs and one DMP after the ACTs. Time set 7 h includes 7 ACTs. That is, 7 h means that ink droplets are discharged using the seven ACT drive waveforms.

Time sets 1 h to 6 h each include DMP at the end. That is, the head drive circuit 101 applies a DMP drive waveform to the actuator 16 after applying one or a plurality of ACT drive waveforms to the actuator 16.

In addition, time sets 1 h to 5 h each include ACT and DMP in the initial frames and include at least one NEG after the DMP drive waveform.

The head drive circuit 101 selects the time set for forming one dot from 0 h to 6 h based on the print data or the like. The head drive circuit 101 applies the ACT drive waveform(s) and the DMP drive waveform to the actuator 16 according to the selected time set. In addition, the head drive circuit 101 sets a rest period with a predetermined width between the ACT drive waveform and the next ACT drive waveform, and between the ACT drive waveform and the DMP drive waveform.

In other examples, time sets 1 h to 5 h each may include ACT and DMP in the final (or trailing) frames of the set rather than in the initial (or leading) frames of the set.

Next, the pressure or the like generated in the pressure chamber 15 when the head drive circuit 101 applies the ACT drive waveform(s) and the DMP drive waveform will be described.

Figure 12:
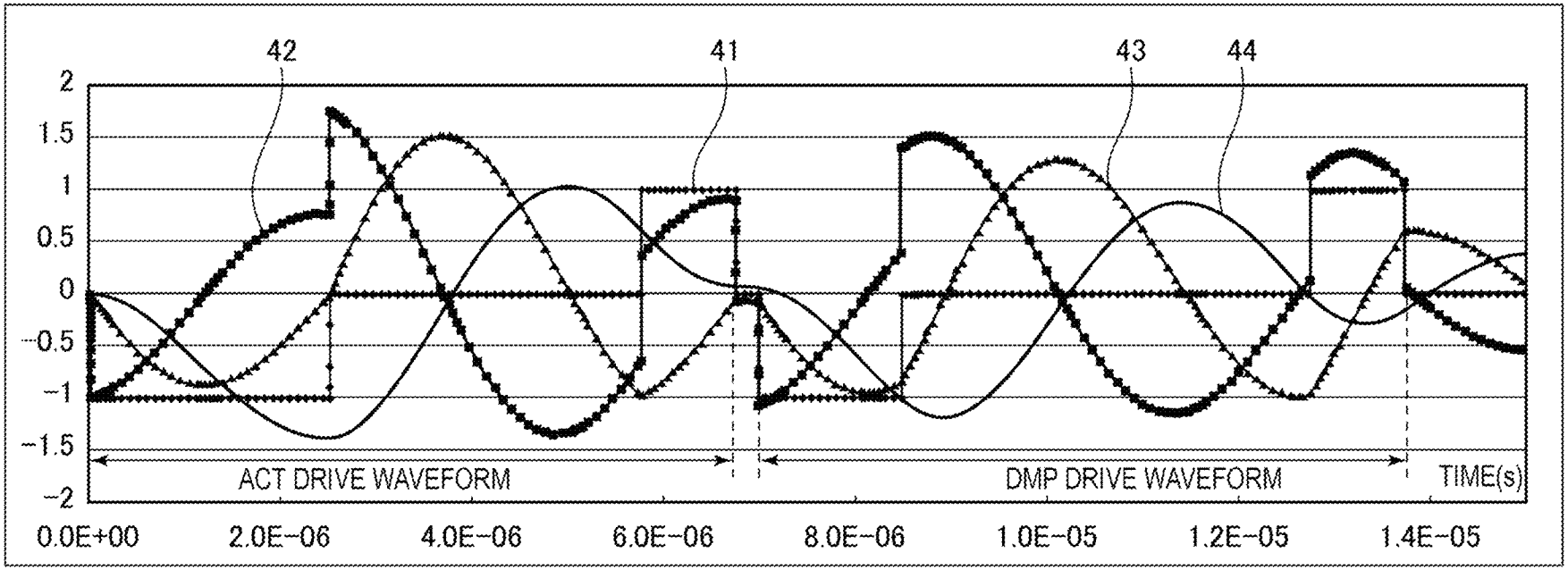
FIG. 12 is a graph showing a pressure in a pressure chamber according to the embodiment.

FIG. 12 is a graph showing the pressure generated in the pressure chamber 15 when the head drive circuit 101 applies the ACT drive waveform and then the DMP drive waveform.

FIG. 12 shows the pressure or the like when the head drive circuit 101 applies the ACT drive waveform and then the subsequent DMP drive waveform. That is, FIG. 12 shows the pressure or the like when the head drive circuit 101 applies a drive waveform for discharging the last two ink droplets.

In FIG. 12, lines 41 to 44 are shown.

The line 41 represents the voltage applied to the actuator 16 by the head drive circuit 101.

The line 42 represents the pressure generated in the pressure chamber 15.

The line 43 represents the speed of the meniscus 20 formed in the nozzle 8.

The line 44 represents the integral of the line 43.

As indicated by the line 41, the ACT drive waveform and the DMP waveform are sequentially applied to the actuator 16.

As indicated by the line 42, the pressure in the pressure chamber 15 is increased while the first expansion pulse of the ACT drive waveform is applied. When the first expansion pulse ends (the first release period starts), the pressure in the pressure chamber 15 is further increased.

As indicated by the line 43, in the first release period, the flow velocity of the meniscus 20 is increased. When the flow velocity of the meniscus 20 exceeds a predetermined threshold value, ink droplets are discharged from the nozzle 8 at the first speed.

Similarly, as indicated by the line 42, the pressure in the pressure chamber 15 is increased while the second expansion pulse of the DMP drive waveform is applied. In addition, when the second expansion pulse ends (when the second release period starts), the pressure in the pressure chamber 15 is further increased. Since the width of the second expansion pulse is shorter than the width of the first expansion pulse, the peak of the pressure in the pressure chamber 15 in the section in which the DMP drive waveform is applied is smaller than that in the section in which the ACT drive waveform is applied. That is, the pressure generated by the DMP drive waveform is smaller than the pressure generated by the ACT drive waveform.

As indicated by the line 43, in the second release period, the flow velocity of the meniscus 20 is increased. When the flow velocity of the meniscus 20 exceeds a predetermined threshold value, ink droplets are discharged from the nozzle 8 at the second speed.

Since the pressure generated by the DMP drive waveform is smaller than the pressure generated by the ACT drive waveform, the peak of the speed of the meniscus 20 in the section in which the DMP drive waveform is applied is smaller than that in the section in which the ACT drive waveform is applied. Therefore, in the section in which the DMP drive waveform is applied, ink droplets are discharged from the nozzle 8 at the second speed slower than the first speed.

Next, a discharged (flying) state of ink droplets will be described.

Figure 13:
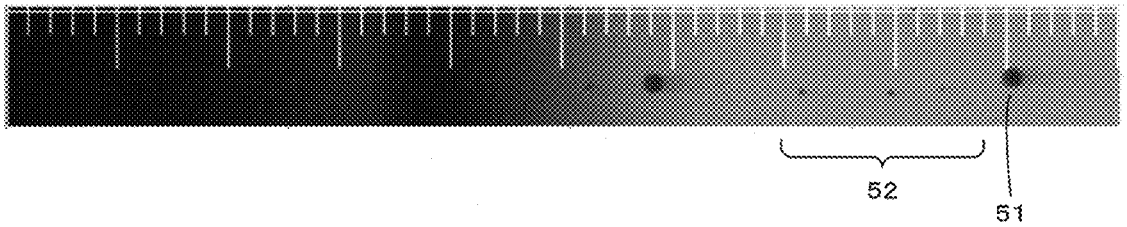
FIG. 13 is a diagram illustrating a discharge state of ink droplets discharged by an inkjet head according to a comparative example.

First, a discharged state of ink droplets discharged by an inkjet head when no DMP drive waveform is applied will be described. FIG. 13 shows the discharged state of ink droplets discharged by an inkjet head when only the ACT drive waveform is applied without applying the DMP drive waveform as a comparative example. FIG. 13 shows a state in which the inkjet head is arranged on the left side and ink droplets are continuously discharged to the right side from the inkjet head. In the example shown in FIG. 13, the head drive circuit applies the ACT drive waveform to the actuator. That is, the head drive circuit applies the same number of ACT drive waveforms as the number of ink droplets to be discharged to the actuator and does not apply the DMP drive waveform.

In the example shown in FIG. 13, it can be seen that an integrated ink droplet 51 and mist 52 were formed.

The integrated ink droplet 51 is an integrated ink droplet of the ink droplets discharged by the ACT drive waveform. When a plurality of ink droplets are discharged, the inkjet head discharges the plurality of ink droplets by the ACT drive waveform. The inkjet head discharges subsequent ink droplets at a speed faster than the speed of the preceding ink droplets. Therefore, the ink droplets discharged by each ACT drive waveform follow the preceding ink droplet and are integrated. The integrated ink droplet 51 is an ink droplet formed by integrating each ink droplet.

The mist 52 is generated by each ink droplet. For example, in the ink droplets discharged by the inkjet head, a tail extending from the ink droplet to the meniscus 20 may be formed. It is considered that when the ink droplets fly, the tail scatters to form mist.

When the inkjet head discharges a plurality of ink droplets, a subsequent ink droplet may absorb the tail or mist of the preceding ink droplet. However, the tail or mist of the last ink droplet cannot be absorbed by other subsequent ink droplets. That is, the mist 52 is considered to be mainly formed from the mist generated by the last ink droplet.

When the head drive circuit 101 applies one ACT drive waveform, an integrated ink droplet 61 is an ink droplet discharged by one ACT drive waveform.

Figure 14:
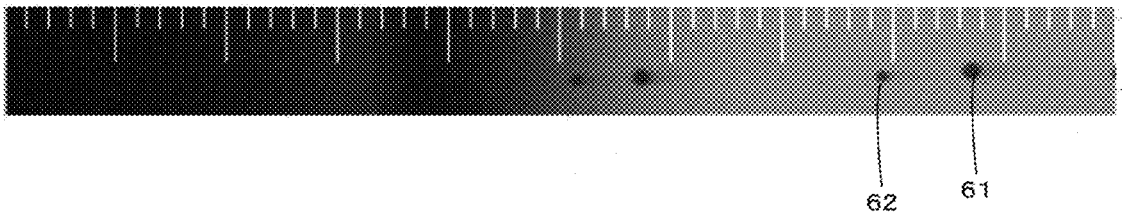
FIG. 14 is a diagram illustrating a discharge state of ink droplets discharged by the inkjet head according to the embodiment.

Next, when the DMP drive waveform is applied, the discharged state of the ink droplets discharged by the inkjet head 100 will be described. FIG. 14 shows the discharged state of the ink droplets discharged by the inkjet head 100 when the ACT drive waveform and the DMP drive waveform are applied. Similarly, FIG. 14 shows a state in which the inkjet head 100 is arranged on the left side and the ink droplets are continuously discharged to the right side from the inkjet head 100. In the example shown in FIG. 14, the head drive circuit applies the DMP drive waveform to the actuator subsequent to the ACT drive waveform. That is, the head drive circuit applies one DMP drive waveform to the actuator subsequent to the (number of ink droplets to be discharged−1) ACT drive waveforms.

In the example shown in FIG. 14, it can be found the integrated ink droplet 61 and an ink droplet 62 were formed.

The integrated ink droplet 61 is an integrated ink droplet discharged by the ACT drive waveform, similar to the integrated ink droplet 51 of FIG. 13. Here, the inkjet head discharges a plurality of ink droplets by the ACT drive waveform. When the inkjet head discharges a plurality of ink droplets by the ACT drive waveform, the subsequent ink droplet is discharged at a speed faster than the speed of the preceding ink droplet. Therefore, the ink droplets discharged by each ACT drive waveform follow the preceding ink droplet and are integrated. The integrated ink droplet 61 is an ink droplet formed by integrating each ink droplet discharged by the ACT drive waveform.

The ink droplet 62 is an ink droplet discharged by the DMP drive waveform. As described above, the ink droplet 62 is discharged at a speed (second speed) slower than the speed (first speed) of the ink droplet discharged by the ACT drive waveform. Therefore, the ink droplet 62 cannot follow the integrated ink droplet 61 and does not integrate with the integrated ink droplet 61.

Since the ink droplet 62 follows the ink droplet discharged by the ACT drive waveform, the mist of the ink droplet (mainly the last ink droplet discharged by the ACT drive waveform) is absorbed.

Since the ink droplet 62 is discharged at the second speed, the formation of the tail is suppressed by the ink droplet discharged by the ACT drive waveform. Therefore, the formation of the mist is suppressed by the ink droplet 62.

When the head drive circuit 101 discharges one ACT drive waveform and then applies one DMP drive waveform to the actuator 16, the integrated ink droplet 61 is an ink droplet discharged by one ACT drive waveform.

The ACT drive waveform may not include the first contraction pulse. The first expansion pulse or the first contraction pulse may cause a voltage change in a plurality of stages. The configuration of the ACT drive waveform is not limited to a specific configuration.

The DMP drive waveform may not include the second contraction pulse. The second expansion pulse or the second contraction pulse may cause a voltage change in a plurality of stages. The configuration of the DMP drive waveform is not limited to a specific configuration.

The head drive circuit 101 may set a time set that does not include DMP.

The inkjet head configured as described above discharges the last ink droplet using the DMP drive waveform when forming a dot in multi-drop mode. Therefore, the inkjet head discharges the last ink droplet at a speed slower than the speed of the preceding ink droplet. As a result, the inkjet head allows the last ink droplet to absorb the mist of the preceding ink droplet. The inkjet head can suppress the mist of the ink droplet since the speed of the last ink droplet is slow.

Thus, the inkjet head can suppress deterioration in print quality due to the mist.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid discharge head, comprising:

an actuator configured to expand and contract a pressure chamber; and a drive circuit configured to, during a dot formation period divided into a plurality of frames, repeatedly apply a first drive waveform during multiple consecutive frames of the plurality of frames to cause the actuator to discharge a liquid droplet at a first speed, and then apply one second drive waveform during a frame immediately subsequent to a last frame of the multiple consecutive frames of the plurality of frames to cause the actuator to discharge a liquid droplet at a second speed slower than the first speed, wherein during the dot formation period, no drive waveform to discharge a liquid droplet is applied to the actuator after the second drive waveform is applied.

2. The liquid discharge head according to claim 1, wherein no other drive waveform to discharge a liquid droplet is applied to the actuator between the first drive waveforms and the second drive waveform.

3. The liquid discharge head according to claim 1, wherein the drive circuit applies one of the first drive waveforms to the actuator during a first one of the frames, and the second drive waveform to the actuator during a second one of the frames immediately subsequent to the first one of the frames.

4. The liquid discharge head according to claim 1, wherein during at least one of the plurality of frames no drive waveform to discharge a liquid droplet is applied to the actuator.

5. The liquid discharge head according to claim 1, wherein the first drive waveform includes a first expansion pulse that causes the actuator to expand the pressure chamber from a relaxed state, the second drive waveform includes a second expansion pulse that causes the actuator to expand the pressure chamber from the relaxed state, and a width of the second expansion pulse is narrower than a width of the first expansion pulse.

6. The liquid discharge head according to claim 1, wherein the first drive waveform includes a first expansion pulse that causes the actuator to expand the pressure chamber from a relaxed state, then a first release period in which the pressure chamber returns to the relaxed state, and then a first contraction pulse that causes the actuator to contract the pressure chamber from the relaxed state, the second drive waveform includes a second expansion pulse that causes the actuator to expand the pressure chamber from the relaxed state, then a second release period in which the pressure chamber returns to the relaxed state, and then a second contraction pulse that causes the actuator to contract from the relaxed state, a width of the second expansion pulse is narrower than a width of the first expansion pulse, and a duration of the second release period is longer than a duration of the first release period.

7. A printer, comprising:

a print media conveyer;

a liquid discharge head; and a processor configured to control the print media conveyer and the liquid discharge head, wherein the liquid discharge head comprises:

an actuator configured to expand and contract a pressure chamber; and a drive circuit configured to apply a first plurality of first drive waveforms to cause the actuator to discharge a plurality of liquid droplets at a first speed, and then a second drive waveform after the first drive waveforms to cause the actuator to discharge a liquid droplet at a second speed slower than the first speed.

8. The printer according to claim 7, wherein no other drive waveform to discharge a liquid droplet is applied to the actuator between a last one of the first drive waveforms and the second drive waveform.

9. The printer according to claim 7, wherein during a dot formation period divided into a plurality of frames, no drive waveform to discharge a liquid droplet is applied to the actuator after the second drive waveform is applied, and the drive circuit applies one of the first drive waveforms to the actuator during a first one of the frames, and the second drive waveform to the actuator during a second one of the frames immediately subsequent to the first one of the frames.

10. The printer according to claim 7, wherein during a dot formation period divided into a plurality of frames, no drive waveform to discharge a liquid droplet is applied to the actuator after the second drive waveform is applied, and the drive circuit repeatedly applies the first drive waveform to the actuator for multiple consecutive frames of the plurality of frames, and then the second drive waveform to the actuator during a frame immediately subsequent to a last frame of the multiple consecutive frames of the plurality of frames.

11. The printer according to claim 7, wherein during a dot formation period divided into a plurality of frames, no drive waveform to discharge a liquid droplet is applied to the actuator after the second drive waveform is applied, and during at least one of the plurality of frames no drive waveform to discharge a liquid droplet is applied to the actuator.

12. The printer according to claim 7, wherein the first drive waveform includes a first expansion pulse that causes the actuator to expand the pressure chamber from a relaxed state, the second drive waveform includes a second expansion pulse that causes the actuator to expand the pressure chamber from the relaxed state, and a width of the second expansion pulse is narrower than a width of the first expansion pulse.

13. The printer according to claim 7, wherein the first drive waveform includes a first expansion pulse that causes the actuator to expand the pressure chamber from a relaxed state, then a first release period in which the pressure chamber returns to the relaxed state, and then a first contraction pulse that causes the actuator to contract the pressure chamber from the relaxed state, the second drive waveform includes a second expansion pulse that causes the actuator to expand the pressure chamber from the relaxed state, then a second release period in which the pressure chamber returns to the relaxed state, and then a second contraction pulse that causes the actuator to contract from the relaxed state, a width of the second expansion pulse is narrower than a width of the first expansion pulse, and a duration of the second release period is longer than a duration of the first release period.

14. A liquid discharge head, comprising:

an actuator configured to expand and contract a pressure chamber; and a drive circuit configured to apply a first plurality of first drive waveforms to cause the actuator to discharge a plurality of liquid droplets at the first speed, and then a second drive waveform after the first drive waveforms to cause the actuator to discharge a liquid droplet at a second speed slower than the first speed.

15. The liquid discharge head according to claim 14, wherein no other drive waveform to discharge a liquid droplet is applied to the actuator between the first drive waveforms and the second drive waveform.

16. The liquid discharge head according to claim 14, wherein a dot formation period is divided into a plurality of frames, and the drive circuit applies one of the first drive waveforms to the actuator during a first one of the frames, and the second drive waveform to the actuator during a second one of the frames immediately subsequent to the first one of the frames.

17. The liquid discharge head according to claim 14, wherein a dot formation period is divided into a plurality of frames, and during at least one of the plurality of frames no drive waveform to discharge a liquid droplet is applied to the actuator.

18. The liquid discharge head according to claim 14, wherein the first drive waveform includes a first expansion pulse that causes the actuator to expand the pressure chamber from a relaxed state, the second drive waveform includes a second expansion pulse that causes the actuator to expand the pressure chamber from the relaxed state, and a width of the second expansion pulse is narrower than a width of the first expansion pulse.

19. The liquid discharge head according to claim 14, wherein the first drive waveform includes a first expansion pulse that causes the actuator to expand the pressure chamber from a relaxed state, then a first release period in which the pressure chamber returns to the relaxed state, and then a first contraction pulse that causes the actuator to contract the pressure chamber from the relaxed state, the second drive waveform includes a second expansion pulse that causes the actuator to expand the pressure chamber from the relaxed state, then a second release period in which the pressure chamber returns to the relaxed state, and then a second contraction pulse that causes the actuator to contract from the relaxed state, a width of the second expansion pulse is narrower than a width of the first expansion pulse, and a duration of the second release period is longer than a duration of the first release period.

* * * * *